US007771293B1

(12) United States Patent
Vann

(10) Patent No.: US 7,771,293 B1
(45) Date of Patent: Aug. 10, 2010

(54) BASKETBALL SHOOTING TRAINING AID AND METHOD FOR ITS USE

(76) Inventor: Kayode Teddy Vann, 222 E. 93rd St., apt. 9D, New York, NY (US) 10128

( * ) Notice: Subject to any disclaimer, the term of this patent is extended or adjusted under 35 U.S.C. 154(b) by 0 days.

(21) Appl. No.: 12/398,830

(22) Filed: Mar. 5, 2009

Related U.S. Application Data

(63) Continuation of application No. 11/164,434, filed on Nov. 22, 2005, now abandoned.

(51) Int. Cl.
*A63B 69/00* (2006.01)

(52) U.S. Cl. ..... 473/422; 473/450; 473/458; 473/447

(58) Field of Classification Search ..... 473/450, 473/458, 464, 447, 212–214, 220, 224, 221; 434/247–257; 463/48, 36, 37
See application file for complete search history.

(56) References Cited

U.S. PATENT DOCUMENTS 1,165,970 A * 12/1915 Harris ..... 340/321
3,269,729 A * 8/1966 Morrison ..... 473/63
3,673,697 A * 7/1972 Wasson ..... 33/348
3,707,291 A * 12/1972 Tredway ..... 473/202
3,762,719 A * 10/1973 Smith ..... 473/212
3,820,783 A 6/1974 Caveness
RE28,661 E * 12/1975 Tredway, Sr. ..... 473/202
4,193,065 A * 3/1980 Bittner ..... 473/214
5,067,717 A * 11/1991 Harlan et al. ..... 473/209
5,149,085 A 9/1992 Sanchez
5,236,190 A 8/1993 Moss
5,354,050 A 10/1994 McCarthy
5,544,877 A * 8/1996 Brownell ..... 473/450
5,865,695 A * 2/1999 Mahala et al. ..... 473/450
5,876,292 A 3/1999 Hamilton
6,148,280 A 11/2000 Kramer
9,618,844 7/2005 Socci

* cited by examiner

*Primary Examiner*—Mitra Aryanpour
(74) *Attorney, Agent, or Firm*—Ted Sabety; Sabety +associates, PLLC

(57) ABSTRACT

The present invention provides a shooting aid for basketball players including a device worn by a basketball player to aid the player's shooting forearm to be kept parallel to the centerline of the body during the shooting motion without any apparatus restraints. The centerline of the body is an imaginary line dividing the player vertically down the middle of his or her body. The shooting aid comprises a sleeve adapted to fit around the forearm or wrist of the shooting arm of the basketball player. The sleeve carries a light that brightly illuminates in response to the forearm of the shooter being in a vertical position.

11 Claims, 2 Drawing Sheets

BASKETBALL SHOOTING TRAINING AID AND METHOD FOR ITS USE

This application is a continuation of and claims priority to U.S. patent application Ser. No. 11/164,434, filed on Nov. 22, 2005 now Abandoned, and which is herein incorporated by reference in its entirety.

BACKGROUND OF THE INVENTION

The present invention relates to the field of sports training devices, and more particularly to a basketball shooting training aid.

Basketball is one of the top sports in the world. Points are predominately scored by shooting the basketball through a hoop generally mounted ten feet above the playing surface. Excellent shooting form and technique increases the player's ability to score points.

Numerous methods of shooting have been developed over the years, and some are still widely used today. For example, there are shots known as the lay up, hook shot, the one hand set shot, two hand set shot, the underhand shot, the one hand push shot, the one hand jump shot, the dunk shot, the foul shot, and the finger roll. Of all these shots, the shots that incorporate the techniques used in the one hand push shot are mostly used in the one hand jump shot, the one hand set shot, and foul shot. These techniques are frequently used and have developed into an increased importance in scoring in the modem game of basketball.

The proper techniques used in the one hand push shot with the opposite hand used as a prerelease stabilizer or guide is critical to achieving effectiveness and efficiency in scoring points. In the preferred method for executing a one hand push shot with opposite hand used as a pre-release stabilizer or guide, the forearm of the shooting arm is kept parallel to the center line of the body during the shooting motion. The centerline of the body is an imaginary line dividing the player vertically down the middle of his or her body. When the forearm of the shooting is not aligned with the centerline when shooting, the basketball has the tendency to stray from its proper shooting trajectory. This tendency causes a decrease in the percentage of shots that fall through the hoop.

DESCRIPTION OF RELATED ART

As can be seen by reference to the following U.S. Pat. Nos. 3,820,783; 5,149,085; 5,236,190; 5,544,877 and 5,876,292, the prior art is replete with myriad and diverse sports training devices.

While all of the aforementioned prior art constructions are adequate for the basic purpose and function for which they have been specifically designed, they are uniformly deficient with respect to their failure to provide a simple, efficient, and practical basketball shooting training aid.

As a consequence of the foregoing situation, there has existed a longstanding need for a new and improved basketball shooting training aid, and the provision of such a construction is a stated objective of the present invention.

BRIEF SUMMARY OF THE INVENTION

Briefly stated, the present invention provides a shooting aid for basketball players including a device worn by a basketball player to aid the player's shooting forearm to be kept parallel to the centerline of the body during the shooting motion without any apparatus restraints. The centerline of the body is an imaginary line dividing the player vertically down the middle of his or her body. The shooting aid comprises a sleeve adapted to fit around the forearm or wrist of the shooting arm of the basketball player. In one embodiment, the sleeve carries a light that brightly illuminates in response to the forearm of the shooter being in a substantially vertical position. Other embodiments can use other indicating devices.

Accordingly, it is an object of the present invention to provide a training aid for basketball players which is worn by the player and which serves to train the player to keep his elbow in toward the center of his body during the shooting motion illustrated in FIG. 2, which is the proper alignment when executing a basketball shot.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
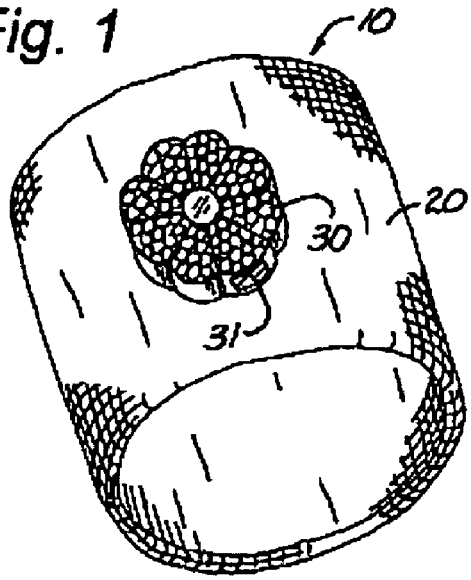
FIG. 1 is a perspective view of the basketball shooting training aid of the present invention.

As can be seen by reference to the drawings, and in particular to FIG. 1, the basketball shooting training aid that forms the basis of the present invention is designated generally by the reference number 10. The invention addresses the problem of effectively training and improving basketball players in acquiring the perfect shot. Players of all skill levels tend to have their shooting forearm stray from the centerline of the body (elbow moves away from the center of the body) during the shooting motion, thereby increasing the margin for an undesirable trajectory. If, however, the player's shooting forearm is kept parallel to the centerline of the body during the shooting motion, the proper ball trajectory is apt to ensue. Therefore, it is necessary to eliminate the common habit and tendency of the player's shooting forearm to stray from the centerline of the body if the correct shooting technique is to be attained.

The invention relates to shooting and training aid which is adapted to be worn by a basketball player for the purpose of developing a perfect basketball shot and for increasing shooting percentages by training a basketball player in proper shooting techniques. In a preferred embodiment, the apparatus 10 includes an elastic sleeve 20 that is stretchable and fits snugly over the forearm of the player's shooting arm. This elastic sleeve 20 carries a visual illuminated indicator 30 which is visible to the player during the act of shooting. This indicator 30 responds to the upward vertical position of the forearm of the shooter. A player can repeatedly perform a shooting motion while using the device 10 so that the player's muscles memorize and grow accustomed to the proper shooting technique, thus shooting the perfect shot.

Figure 5:
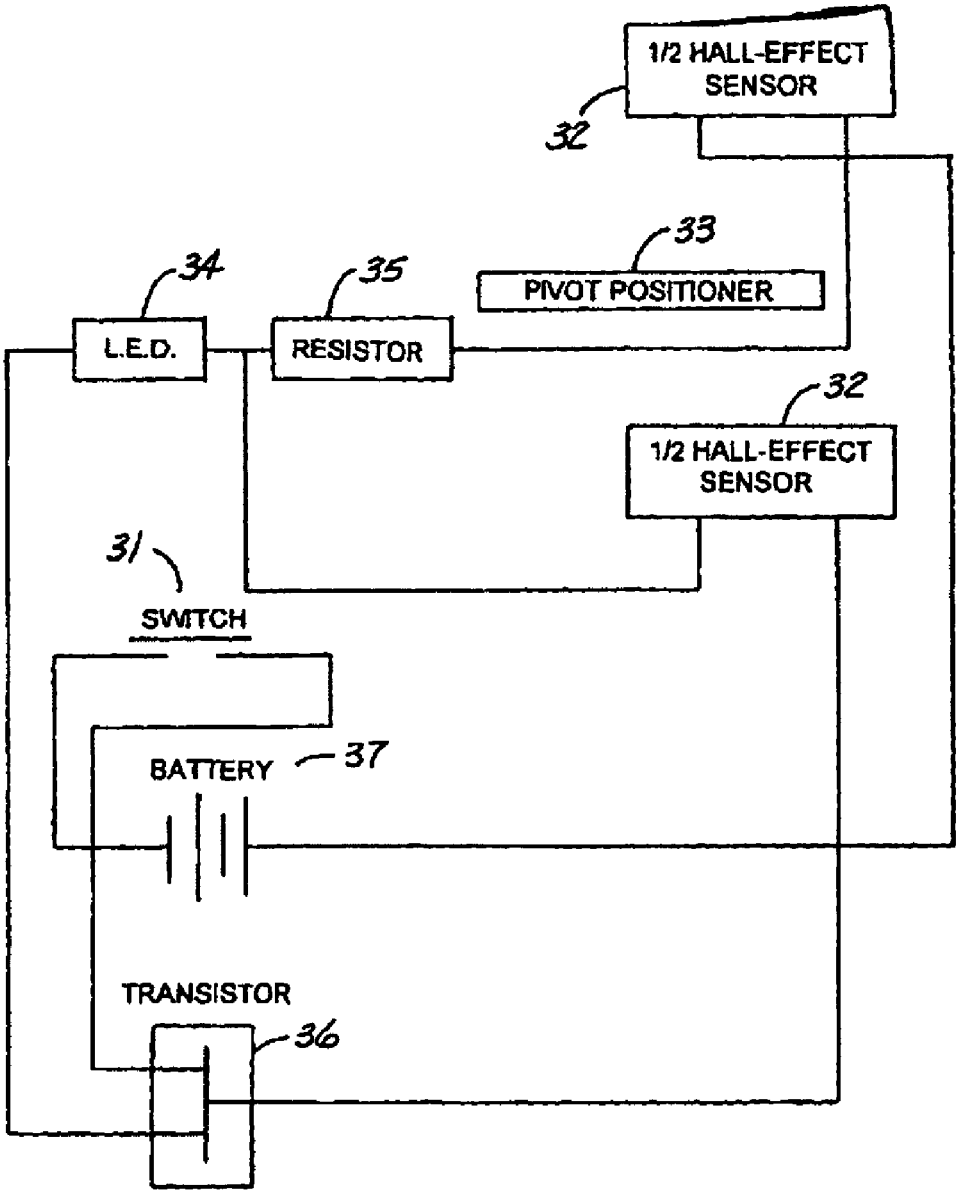
FIG. 5 is a circuit diagram showing the components of the visual illuminated forearm position indicator.

The electrical circuit for the indicator 30 is shown in FIG. 5. The circuit functions to visually display varying degrees of pitch (level) from negative values to neutral (zero) values to positive values or positive values to a neutral (zero) values to negative values. The circuit consists of an on-off switch 31, Hall Effect sensor 32, a pivoting positioner 33, LED 34 (light emitting diode), load resistor 35, driver transistor 36, and battery 37.

Figure 2:
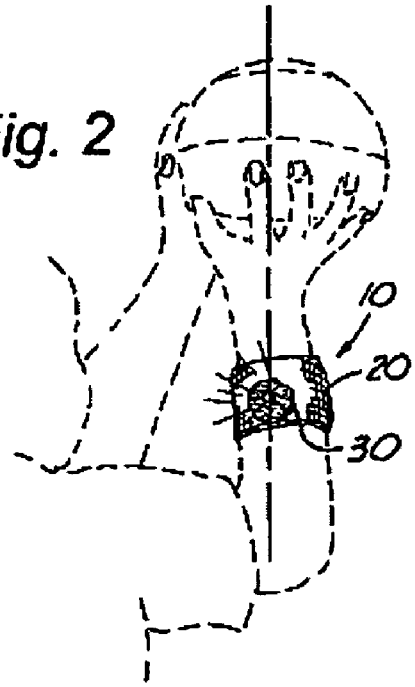
FIG. 2 is a perspective view showing the training aid positioned on the shooter's forearm and being brightly illuminated since the forearm is in a vertical position.
Figure 3:
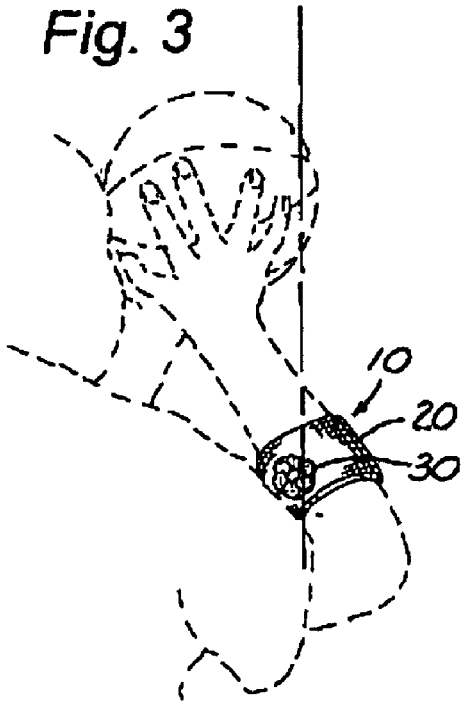
FIG. 3 is a perspective view similar to FIG. 2, but showing the shooter's forearm inclined to the left of vertical.
Figure 4:
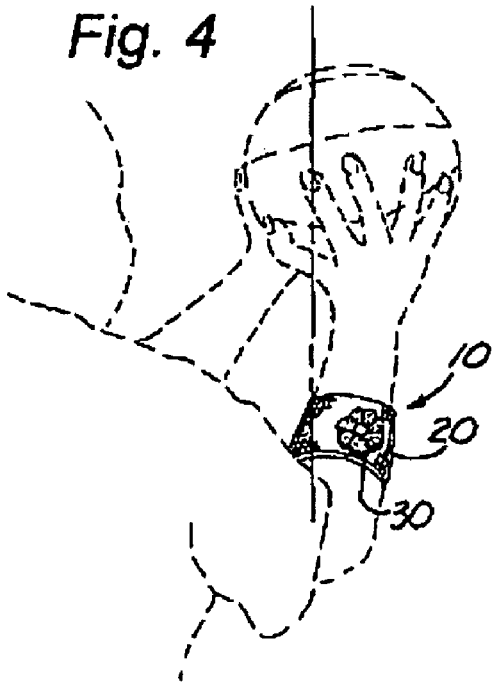
FIG. 4 is a perspective view similar to FIG. 2, but showing the shooter's forearm inclined to the right of vertical.

Closing the on-off switch 31 supplies current through a battery 37, driver transistor 36, Hall Effect sensor 32, load resistor 35, and LED 34. The physical position of the pivoting positioning device 33 varies the amount of current that passes through the LED 34 varying its' brightness, color and/or numerical degree read out. When the device is not level, the LED 34 displays varying degrees of brightness, color and/or numerical degree read out. When the device is perfectly level, the LED 34 reaches its maximum brightness, specific color and/or numerical degree read out as illustrated in FIG. 2.

The light emits from the forearm position indicator 30 located on the elastic sleeve 20. In addition to the visual illuminated indicator, it is to be understood that audio and vibrating indicators could be added to augment the visual response.

The light indicator 30 also serves as a physical reference for the player's point of release. In the preferred shooting motion, the light indicator 30 should be around eye level at the point of release of the basketball.

The electronic device may include an on and off switch, lock and unlock setting (making it detachable from the elastic sleeve and interchangeable with other elastic sleeves or attachments/adhesives), an adjustable leveler detector (for unleveled playing surfaces or for the player's preferred forearm shooting angle), and fashion modes (light and audio option that do not respond to the position of the forearm, but are used solely for the purpose of fun and fashion).

The present invention satisfies the player's training needs by providing a shooting device to aid in the player's shooting forearm to be kept parallel to the centerline of the body during the shooting motion. Additionally, the invention accomplishes the preceding objectives by providing a device which possesses the additional attributes of being wearable on the shooting arm of the player, being gender neutral, being useful to players of all skill levels, being adaptable to a right or left handed player, being susceptible of ready and easy attachment to the arm of the player, being adjustable for various arm sizes, being safe, being capable of being worn for any type of shot, and being capable of being used with or without a ball.

The training aid provides a method and device to improve the accuracy of shooting a basketball, improve the arch of shooting a basketball, improve the point of release of the basketball during the player's shooting motion, and improve the positioning of a basketball on the backboard when shooting at an angle off the backboard.

The training aid is convenient, lightweight, stylish, safe and absorbent. While some basketball training aids are known and commercially available, most of the known devices are bulky and cumbersome. A need exists in the art for improved lightweight devices that are easier to use and help train basketball players in proper shooting technique without unnecessary physical restrictions or movement. This device relies on muscle memory and repetition. In particular, a device is needed which will not interfere in any way with the basketball, or with the normal freedom of motion of the shooter.

The use of this device does not interfere with other aspects of the basketball player's game such as dribbling the basketball, catching the basketball, rebounding the basketball, passing the basketball, playing defense, jumping, or dunking. As a result, the shooting aid can be worn under actual game conditions which makes it unique and represents a distinct advantage over the prior art devices.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

The invention claimed is:

1. A method of training a basketball player comprising the steps of:

(A) providing a shooting device to aid said basketball player to keep parallel his shooting forearm to a vertical centerline of said basketball player body during a shooting motion, said shooting device comprising:

an adjustable sleeve, said adjustable sleeve to be worn on a forearm of said basketball player; a visual indicator operatively attached to said adjustable sleeve, and a pivoting positioning device electronically coupled to said visual indicator;

said shooting device performing the function of being seen by the basketball player when shooting a basketball and serving as a physical reference for said basketball player's point of release by being disposed to emit a variable signal when said basketball player's forearm moves between a vertical position and positions inclined from the vertical; and (B) aiding said basketball player to repeatedly perform a shooting motion while using said shooting device so that said basketball player's muscles memorize and grow to attain a proper shooting technique.

2. The method of claim 1 wherein said visual indicator is LED numerical degree readout.

3. The method of claim 2 wherein said shooting device further includes a vibrating indicator in order to augment a basketball player visual response.

4. The method of claim 2 wherein said shooting device further includes an audible indicator in order to augment a basketball player visual response.

5. The method of claim 1 wherein said adjustable sleeve is formed of an elastic material.

6. The method of claim 1 wherein said visual indicator includes a light of varying color.

7. The method of claim 2 wherein said visual indicator further includes a light of varying degrees of brightness.

8. The method of claim 2 wherein said visual indicator is a light which reaches a maximum brightness when said basketball player's forearm is in the vertical position.

9. The method of claim 1 wherein said shooting device further includes an on/off switch, a hall effect sensor, a pivoting positioner, a load resistor, a driver transistor and a battery for said electrical circuit.

10. The method of claim 1 wherein said shooting device further includes a lock and unlock setting making said shooting device detachable from said adjustable sleeve and interchangeable with other adjustable sleeves.

11. The method of claim 1 wherein said shooting device further includes an adjustable leveler detector.

* * * * *